US006750746B2

(12) United States Patent
Bauer et al.

(10) Patent No.: US 6,750,746 B2
(45) Date of Patent: Jun. 15, 2004

(54) ELECTROMAGNETIC SWITCHING DEVICE, ESPECIALLY CONTRACTOR, WITH A CONTACT BRIDGE SUPPORT LOCK

(75) Inventors: Johann Bauer, Ebermannsdorf (DE); Stephan Faber, Kuemmersbruck (DE); Bardo Koppmann, Kaltenbrunn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/221,782

(22) PCT Filed: Mar. 5, 2001

(86) PCT No.: PCT/DE01/00830

§ 371 (c)(1),
(2), (4) Date: Sep. 17, 2002

(87) PCT Pub. No.: WO01/69623

PCT Pub. Date: Sep. 20, 2001

(65) Prior Publication Data

US 2003/0038694 A1 Feb. 27, 2003

(30) Foreign Application Priority Data

Mar. 17, 2000 (DE) ..... 100 13 319

(51) Int. Cl.[7] ..... H01H 67/02

(52) U.S. Cl. ..... 335/132; 218/48; 218/149; 218/156; 335/201

(58) Field of Search ..... 335/132, 201, 335/202; 218/47, 48, 155, 156, 1, 149

(56) References Cited

U.S. PATENT DOCUMENTS

| | | | | | |
|---|---|---|---|---|---|
| 3,612,796 | A | * | 10/1971 | Doos | 218/149 |
| 3,659,237 | A | * | 4/1972 | Wilsdon | 335/191 |
| 3,673,525 | A | * | 6/1972 | Collins | 335/132 |
| 3,992,599 | A | | 11/1976 | Halbach | |
| 4,223,289 | A | * | 9/1980 | Immel | 335/202 |
| 5,825,269 | A | | 10/1998 | Koppmann | |
| 6,005,202 | A | | 12/1999 | Drexler et al. | |
| 6,162,332 | A | * | 12/2000 | Chiu | 204/192.13 |
| 6,222,146 | B1 | * | 4/2001 | Turkmen | 218/149 |
| 2003/0094439 | A1 | * | 5/2003 | Kling et al. | 218/156 |

FOREIGN PATENT DOCUMENTS

| | | | | |
|---|---|---|---|---|
| DE | 6 752 194 | | 8/1968 | |
| DE | 6752194 | | 3/1969 | |
| DE | 003307062 | A1 * | 9/1984 | H01H/73/18 |
| DE | 3402836 | | 8/1985 | |
| DE | 34 02 836 | A1 | 8/1985 | |
| DE | 4341330 | | 4/1995 | |
| DE | 43 41 330 | C1 | 10/1998 | |
| DE | 195 47 011 | C1 | 12/1999 | |
| JP | 62213020 | A * | 9/1987 | H01H/33/91 |

* cited by examiner

*Primary Examiner*—Lincoln Donovan
*Assistant Examiner*—Bernard Rojas
(74) *Attorney, Agent, or Firm*—Harness, Dickey & Pierce, P.L.C.

(57) ABSTRACT

An electromagnetic switching device, especially a contactor, includes a base, an arc chamber removable from the base, a contact bridge support and a spring-loaded locking element. The contact bridge support projects into the arc chamber and can be displaced in a direction of actuation. The contact bridge support can be locked by the locking element when the arc chamber is taken off. The locking element is configured as a lever that is swiveled about a swiveling axis which extends in perpendicular to the direction of actuation.

20 Claims, 2 Drawing Sheets

ELECTROMAGNETIC SWITCHING DEVICE, ESPECIALLY CONTRACTOR, WITH A CONTACT BRIDGE SUPPORT LOCK

This application is the national phase under 35 U.S.C. §371 of PCT International Application No. PCT/DE01/00830 which has an International filing date of Mar. 5, 2001, which designated the United States of America and which claims priority on German Patent Application number DE 100 13 319.3 filed Mar. 17, 2000, the entire contents of which are hereby incorporated herein by reference.

FIELD OF THE INVENTION

The present invention generally relates to an electromagnetic switching device. In particular, it relates to a contactor, having a lower part, an arcing chamber which can be removed from the lower part, a contact link support and a spring-loaded blocking element, in which the contact link support is held in the lower part, projects into the arcing chamber and can be moved in an operating direction, in which the contact link support can be locked by using the blocking element when the arcing chamber is removed, in which the blocking element is held in the lower part and is in the form of a lever which can pivot about a pivoting axis.

BACKGROUND OF THE INVENTION

A switching device is known, for example, from DE 43 41 330 C1. The known switching device already operates quite well, but the blocking element requires a relatively large amount of space.

A similar electromagnetic switching device is known from DE 34 02 836 A1. In this switching device, the blocking element is mounted in the contact link support.

An electromagnetic switching device is known from DE 195 47 011 C1, in which the contact link support can be locked in its connected position by use of a lever which can pivot, in which case the lever can pivot about a pivoting axis which runs at right angles to the operating direction of the contact link support.

SUMMARY OF THE INVENTION

An object of an embodiment of the present invention is to further develop a switching device which is more compact. An object may be achieved by using a pivoting axis which runs at right angles to the operating direction. If the pivoting element is guided in a bush bearing during pivoting, for example, the blocking element bearing may be particularly simple.

If the blocking element is held in a captive manner in the lower part, the switching device may be particularly reliable in operation. The captive retention can be provided, for example, by the blocking element and the lower part having latching elements which interact in order to hold the blocking element in the lower part, in which case at least one of the latching elements can be deflected in a sprung manner in the direction of the pivoting axis.

If the blocking element interacts with the contact link support in a locking region, and has a ramp incline in the locking region, the contact link support can be configured as required without there being any risk of it undesirably remaining stuck in position before reaching the locked position.

If the blocking element is manually accessible and can be operated manually when the arcing chamber is removed, it is particularly simple to test the switching device for correct operation.

The test is even simpler if, apart from the blocking element, the switching device has no further blocking element for locking the contact link support.

BRIEF DESCRIPTION OF THE DRAWINGS

Further advantages and details can be found in the following description and drawings of an exemplary embodiment. In this case, illustrated in outline form, wherein.

DETAILED DESCRIPTION OF THE PREFERRED EMBODIMENTS

Figure 1:
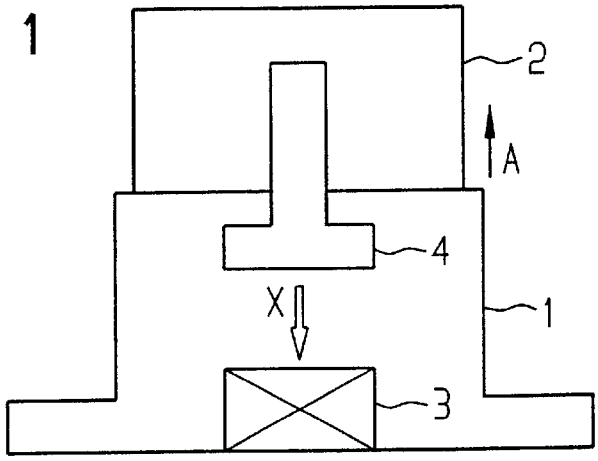
FIG. 1 shows a contactor.

As shown in FIG. 1, a contactor, as an example of an electromagnetic switching device, has a base 1 and an arcing chamber 2. As is indicated by an arrow A in FIG. 1, the arcing chamber 2 can be removed from the base 1.

A drive coil 3 is arranged in the base 1. When a switching current is applied to the drive coil 3, a contact link support 4 is moved in an operating direction x. The contact link support 4 is mounted in the base 1, and projects into the arc chamber 2.

Figure 2:
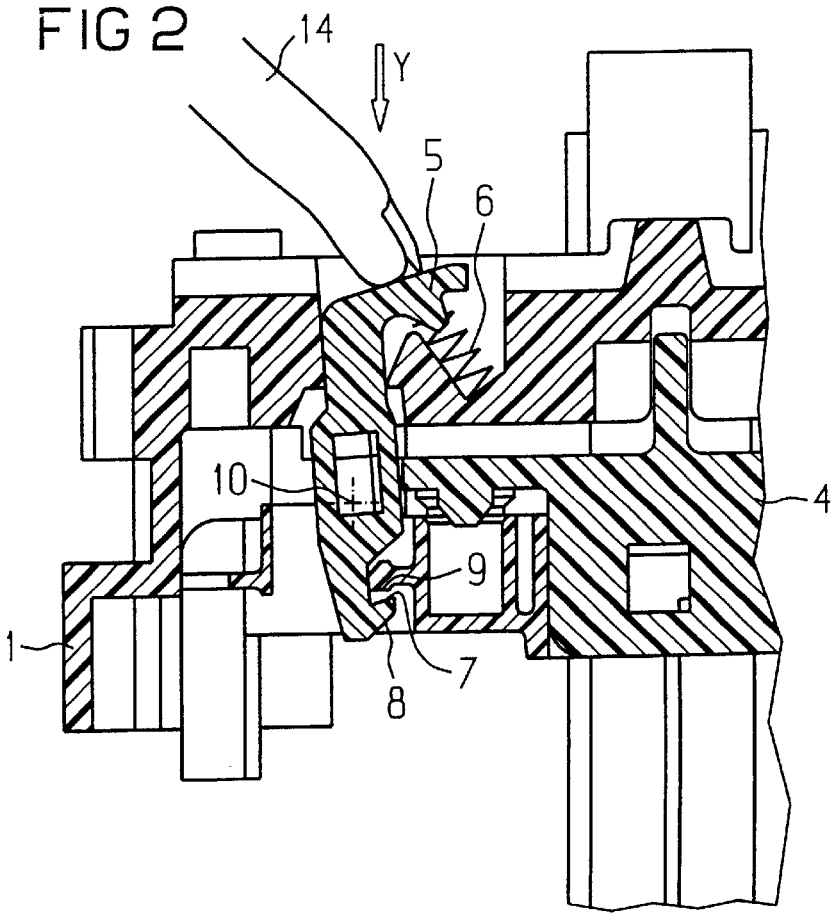
FIG. 2 shows a detail from FIG. 1.

As shown in FIG. 2, the contactor furthermore has a locking element 5, which is spring-loaded by use of a spring 6. As shown in FIG. 2, the spring 6 is in the form of a compression spring. However, in principle, the spring 6 could also be in the form of a tension spring or rotary spring, for example.

When the arcing chamber 2 is removed, the contact link support 4 can be locked with the contactor in the disconnected position, by use of the locking element 5. For this purpose, the locking element 5 interacts with the contact link support 4 in a locking region 7. The locking region 7 is in the form of a hook and has a ramp incline 8 at its lower end. The hook-shaped locking region 7 of the locking element 5 engages in a corresponding mating contour 9 on the contact link support 4, thus locking the contact link support 4.

Figure 3:
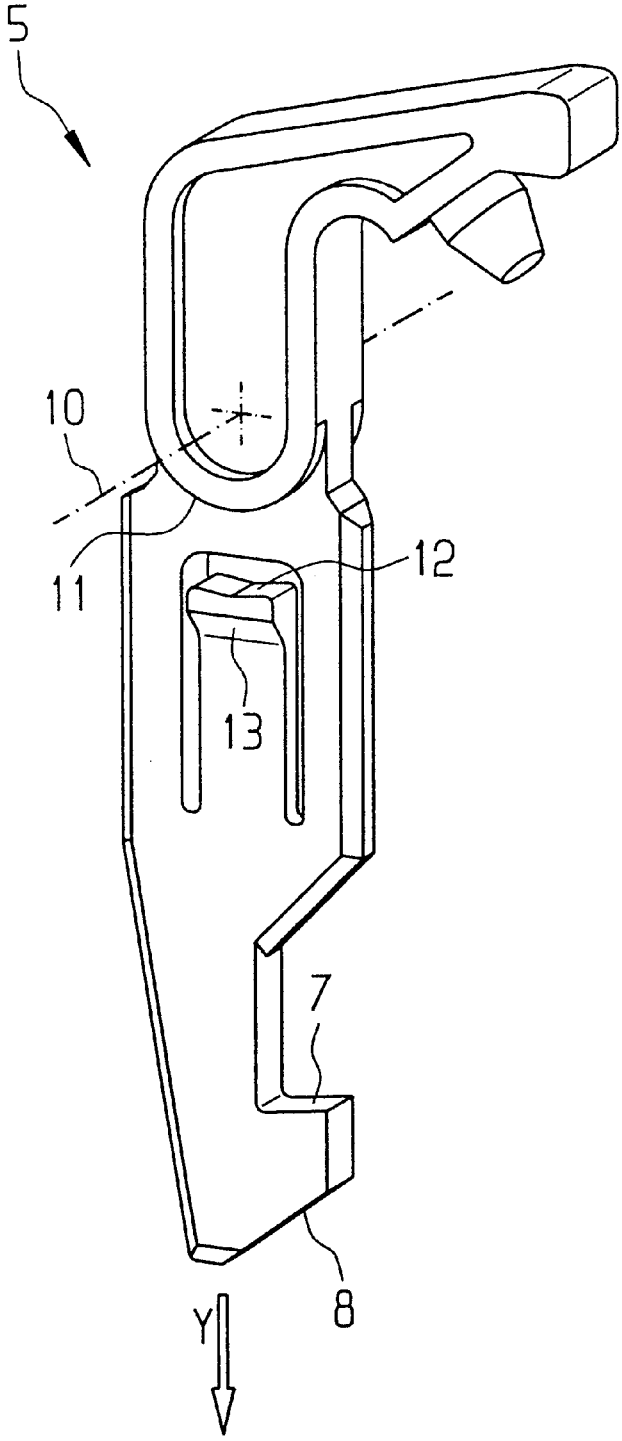
FIG. 3 shows a blocking element.

As shown in FIG. 2, the locking element 5 is in the form of a lever which can pivot about a pivoting axis 10. The pivoting axis 10 in this case runs at right angles to the operating direction x and has a semicircular bearing point 11, which can be mounted in a corresponding bearing bush in the base 1. The locking element 5 is thus guided in a bush bearing 11 during pivoting. As shown in FIG. 3, the locking element 5 also has a latching element 12. The latching element 12 can be deflected in a sprung manner in the direction of the pivoting axis 10. The latching element 12 interacts with a further latching element, which is arranged in the base 1. The further latching element may, but need not necessarily, be capable of being deflected in a sprung manner in the direction of the pivoting axis 10. The interaction of the latching elements 12 results in the locking element 5 being held in a captive manner in the base 1.

The latching element 12 also has a ramp incline 13. The locking element 5 can thus be inserted in the base 1simply by pushing it into the base 1in the insertion direction y.

The process of fitting the arcing chamber 2 to the base 1 necessarily and automatically results in the contact link support 4 being unlocked. As is indicated schematically by a finger 14 in FIG. 2, the locking element 5 is, however, also manually accessible and can be operated manually when the arcing chamber 2 is removed. It is thus possible to unlock the contact link support 4 when the arcing chamber 2 has been removed, and then to test the contactor for correct operation.

The ramp incline 8 ensures that, when the contact link support 4 is moved back to the disconnected position of the contactor, it is impossible for the contact link support 4 to be hooked to the locking element 5 before reaching the disconnected position.

In principle, it is possible to provide a number of locking elements 5 (in particular arranged in symmetrically distributed manner). However, in particular, the test becomes especially simple once the arcing chamber 2 has been removed if the contactor has only a single locking element 5, that is to say it has no further locking element for locking the contact link support 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electromagnetic switching device, comprising:

an arcing chamber, removable from a base;

a contact link support; and a spring-loaded locking element, held in the base, including a lever which can pivot about a pivoting axis, wherein the contact link support is held in the base, projects into the arcing chamber and is movable in an operating direction, wherein the spring-loaded locking element locks the contact link support when the arcing chamber is removed, and wherein the pivoting axis runs at right angles to the operating direction.

2. The switching device as claimed in claim 1, wherein the locking element is guided in a bush bearing during pivoting.

3. The switching device as claimed in claim 1, wherein the locking element is held in a captive manner in the base.

4. The switching device as claimed in claim 3, wherein the locking element and the base include latching elements which interact in order to hold the blocking element in the base, and wherein at least one of the latching elements is deflectable in a sprung manner in the direction of the pivoting axis.

5. The switching device as claimed in claim 1, wherein the locking element interacts with the contact link support in a locking region, and wherein the locking element includes a ramp incline in the locking region.

6. The switching device as claimed in claim 1, wherein, when the arcing chamber is removed, the locking element is manually accessible and is manually operatable.

7. The switching device as claimed in claim 1, wherein, apart from the locking element, the switching device includes no other locking element for locking the contact link support.

8. The electromagnetic switching device of claim 1, wherein the electromagnetic switching device is a contactor.

9. The switching device as claimed in claim 2, wherein the locking element is held in a captive manner in the base.

10. The switching device as claimed in claim 9, wherein the locking element and the base include latching elements which interact in order to hold the locking element in the base, and wherein at least one of the latching elements is deflectable in a sprung manner in the direction of the pivoting axis.

11. The switching device as claimed in claim 2, wherein the locking element interacts with the contact link support in a locking region, and wherein the locking element includes a ramp incline in the locking region.

12. The switching device as claimed in claim 2, wherein, when the arcing chamber is removed, the locking element is manually accessible and is manually operatable.

13. The switching device as claimed in claim 2, wherein, apart from the locking element, the switching device includes no other locking element for locking the contact link support.

14. The switching device as claimed in claim 3, wherein the locking element interacts with the contact link support in a locking region, and wherein the locking element includes a ramp incline in the locking region.

15. The switching device as claimed in claim 3, wherein, when the arcing chamber is removed, the locking element is manually accessible and is manually operatable.

16. The switching device as claimed in claim 3, wherein, apart from the locking element, the switching device includes no other locking element for locking the contact link support.

17. The switching device as claimed in claim 4, wherein the locking element interacts with the contact link support in a locking region, and wherein the locking element includes a ramp incline in the locking region.

18. The switching device as claimed in claim 4, wherein, when the arcing chamber is removed, the locking element is manually accessible and is manually operatable.

19. The switching device as claimed in claim 4, wherein, apart from the locking element, the switching device includes no other locking element for locking the contact link support.

20. An electromagnetic switching device, comprising:

an arcing chamber, removable from a base;

a support, held in the base and adapted to project into the chamber, wherein the support is movable in an operating direction; and a locking element, including a lever which can pivot about a pivoting axis, adapted to lock the support when the arcing chamber is removed from the base, wherein the pivoting axis runs at right angles to the operating direction.

* * * * *